US009750352B2

(12) United States Patent
Harris

(10) Patent No.: US 9,750,352 B2
(45) Date of Patent: Sep. 5, 2017

(54) BABY CARRIER

(71) Applicant: Amelia Gagu Harris, East Point, GA (US)

(72) Inventor: Amelia Gagu Harris, East Point, GA (US)

(73) Assignee: Amelia Gagu Harris, East Point, GA (US)

( * ) Notice: Subject to any disclaimer, the term of this patent is extended or adjusted under 35 U.S.C. 154(b) by 44 days.

(21) Appl. No.: 14/802,304

(22) Filed: Jul. 17, 2015

(65) Prior Publication Data

US 2017/0013971 A1 Jan. 19, 2017

(51) Int. Cl.
*A47D 13/02* (2006.01)

(52) U.S. Cl.
CPC ..... *A47D 13/025* (2013.01)

(58) Field of Classification Search
CPC ..... A47D 13/045; A47D 13/025; A47D 13/02
USPC ..... 224/158–161; D3/213, 214
See application file for complete search history.

(56) References Cited

U.S. PATENT DOCUMENTS

| | | | | |
|---|---|---|---|---|
| 3,229,873 | A | 1/1966 | Hershman | |
| 3,269,621 | A | 8/1966 | Dishart | |
| 4,234,229 | A | 11/1980 | Arnold | |
| 4,469,259 | A | 9/1984 | Krich | |
| 4,492,326 | A | 1/1985 | Storm | |
| 4,923,104 | A | 5/1990 | Rice | |
| 5,609,279 | A | 3/1997 | O'Shea | |
| 5,678,739 | A | 10/1997 | Darling | |
| 6,434,750 | B1 | 8/2002 | Hunter | |
| 6,536,641 | B1 | 3/2003 | Sundara | |
| D527,519 | S * | 9/2006 | Yee | D3/213 |
| 7,661,566 | B2 | 2/2010 | Yoshie | |
| 7,766,199 | B1 * | 8/2010 | Caperon | A47D 13/025 224/158 |
| 7,913,321 | B2 * | 3/2011 | Radcliffe | A41D 1/205 2/104 |
| 2002/0078494 | A1 * | 6/2002 | Hunter | A41B 13/00 2/463 |
| 2005/0205634 | A1 * | 9/2005 | Han | A45F 3/12 224/644 |
| 2007/0175934 | A1 * | 8/2007 | Boal | A47D 13/025 224/159 |
| 2010/0155446 | A1 * | 6/2010 | Stein | A47D 13/025 224/576 |
| 2011/0240693 | A1 * | 10/2011 | Parness | A47D 13/025 224/160 |

(Continued)

FOREIGN PATENT DOCUMENTS

FR 2662339 A * 11/1991

OTHER PUBLICATIONS

Baby Wrap Safety Instructions, Support & Holds for Infants/Boba, http://www.boba.com/support/boba-wrap, May 19, 2015, pp. 1-3.

(Continued)

*Primary Examiner* — Scott McNurlen
(74) *Attorney, Agent, or Firm* — Kristin Crall

(57) ABSTRACT

Embodiments of the present disclosure relate generally to a baby carrier. The baby carrier allows the parent or caregiver to "wear" the baby on his/her back. In one embodiment, the baby carrier is provided as a backpack-like system without buckles, clamps, Velcro, a metal frame, rings or fasteners, or any other non-material components.

6 Claims, 4 Drawing Sheets

(56) References Cited

U.S. PATENT DOCUMENTS

| | | | |
|---|---|---|---|
| 2014/0069968 | A1 | 3/2014 | Frost |
| 2014/0231473 | A1 | 8/2014 | Bailey |

OTHER PUBLICATIONS

The Crossed Rucksack, http://www.calinbleu.com/the-crossed-rucksack, May 16, 2015, pp. 1-3.
Adjustable Cotton Baby Carrier Infant Kids . . . , http://www.aliexpress.com/store/product/Free-Shipping-Adjustable-Cotton-Baby-Carrier-I, May 19, 2015, pp. 1-11.

* cited by examiner

BABY CARRIER

FIELD OF THE DISCLOSURE

Embodiments of the present disclosure relate generally to a baby carrier. The baby carrier allows the parent or other caregiver to "wear" the baby on his/her back. In one embodiment, the baby carrier is provided as a backpack-like system without buckles, clamps, Velcro, a metal frame, rings or fasteners, or any other non-material component.

BACKGROUND

Baby carriers have been used by caregivers around the world for centuries. Many of these carriers are constructed so that the caregiver carries the baby against his/her front torso. One downside of these carriers is that they allow the baby's feet to dangle, which can be dangerous.

More recently, popular baby carriers include a series of complicated straps, buckles, or clasps that secure the baby in place. Concerns with such baby carriers are that the fasteners may snap and cause the child being carried to fall, potentially leading to serious bodily harm or death. Other baby carriers are designed to function as a backpack, but they generally require a heavy frame and/or a series of loops and buckles that secure the baby in place. Improved baby carriers are thus desirable.

BRIEF SUMMARY

Embodiments of the invention described herein thus provide systems and methods for a baby carrier made without buckles, clamps, Velcro, a frame, rings, or fasteners. The carrier includes a main body with four extending members. The main body is designed to safely hold and secure a child. The extending members are designed to be tied around a front of a caregiver in order to secure the child in the baby carrier. Embodiments also provide and accompanying blanket and carrying bag.

DETAILED DESCRIPTION

Figure 1:
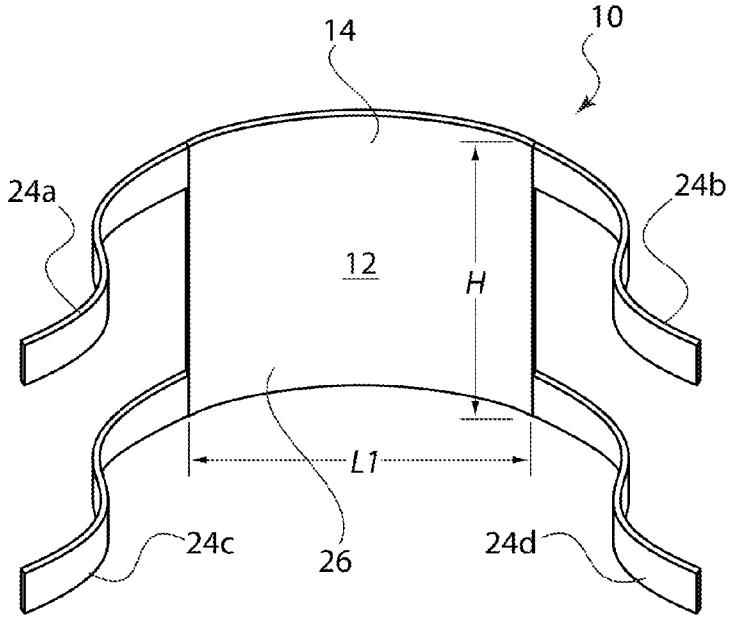
FIG. 1 shows a perspective view of one embodiment of a baby carrier.
Figure 2:
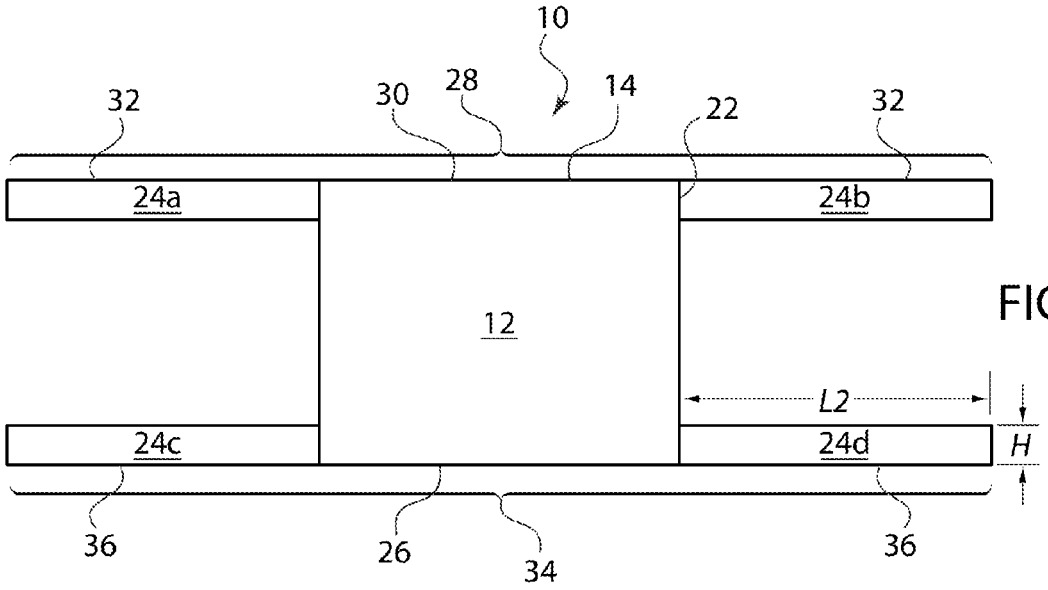
FIG. 2 shows the baby carrier of FIG. 1, with extending members in a straightened position.
Figure 3:
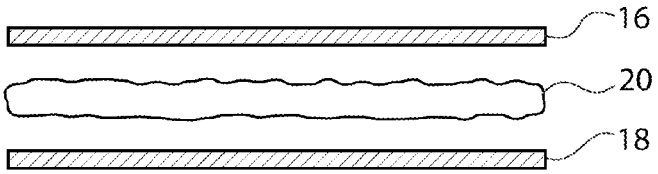
FIG. 3 shows one embodiment for providing padding in the main body.

Embodiments of the present disclosure provide a soft structured baby carrier that may be used for carrying an infant or a toddler against the back of a wearer, in a backpack-style. The baby carrier described herein does not use any rings, Velcro, frames, brackets, or snaps, or any other non-material components. Instead, it enables the child being carried to be enveloped securely within a baby carrier main body 12. As shown in FIGS. 1 and 2, the main body 12 may be formed as a rectangular panel 14. The main body 12 may be padded. For example, pre-padded material may be used to form main body 12. In another example, a first and second layer of material 16, 18 of similar size may be sown to one another, with a layer 20 of a batting, padding, or flannel fabric secured therebetween. One example of this manufacturing method is illustrated by FIG. 3. As is shown in FIG. 1, the main body 12 has a length L1 that allows it to span a substantial portion of an average adult's waist. In one example, the length L1 may be about 25 to about 35 inches. In a more specific example, the length may be about 29-30 inches. The main body has a height H that allows it to extend up a substantial portion of an average adult's back (from waist to shoulder level). In one example, the height H may be about 20 to about 30 inches. In a more specific example, the height H may be about 22-25 inches, or about 24 inches. The resulting dimensions thus provide a rectangular panel 14. It is generally desirable for the main body 12 to be dimensioned such that it can envelope a child's body for security in a way that prevents the child from dropping or falling between the lower edge 26 of the main body 12 and the adult's back.

Figure 4:
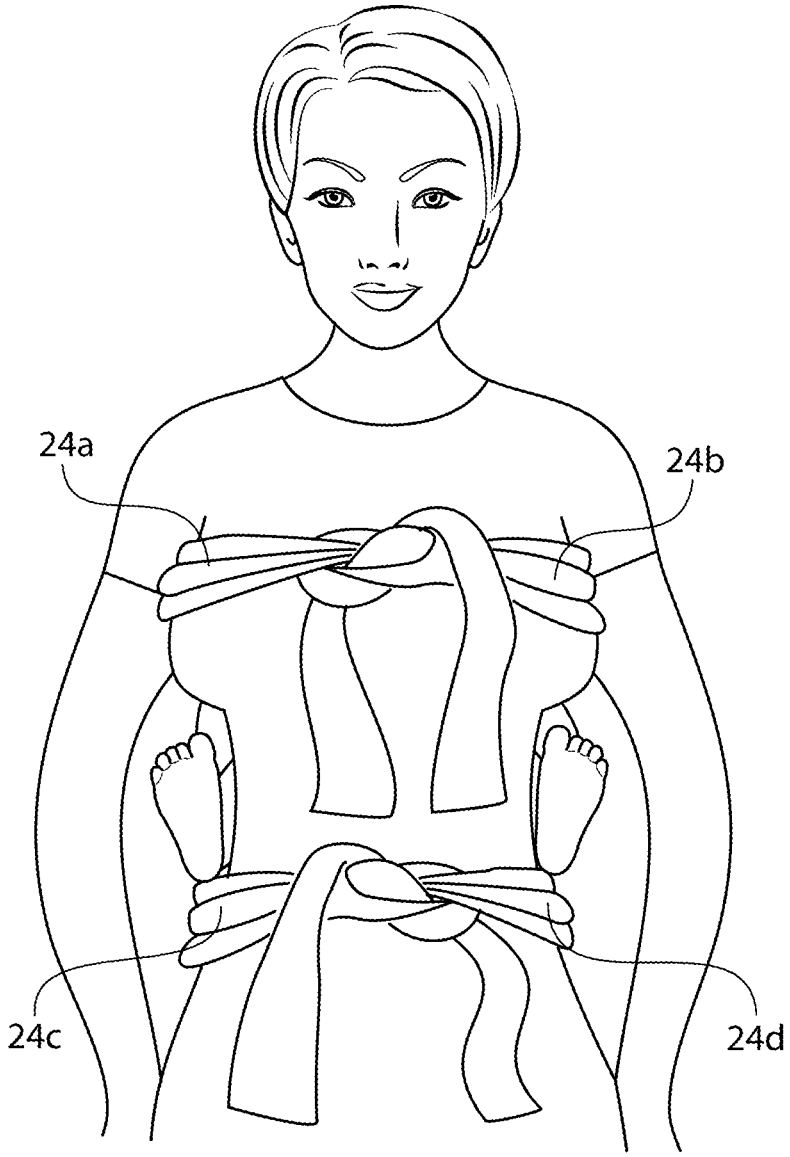
FIG. 4 shows a front perspective view of a caregiver wearing one embodiment of the baby carrier described herein.

Extending from upper and lower side edges 22 of the main body 12 are extending members 24*a-d*. The extending members 24 function as straps or ties in order to secure the main body 12 to the caregiver. As shown in FIGS. 1, 2, and 4, two upper extending members 24*a* and 24*b* function as upper straps. Two lower extending members 24*c* and 24*d* function as lower straps. The extending members 24 may be padded or unpadded. The extending members 24 may be provided of equal dimensions or differing dimensions. In one example, an extending member 24 may have a length L2 of about 25 to about 35 inches. In a more specific example, the extending member 24 may have a length L2 of about 30 inches. It is generally desirable for the extending members 24 to be long enough to span a caregiver's waist and be tied in front of the caregiver. In one example, and extending member 24 may have a height H of about 1 to about 8 inches. In a more specific example, the extending member may have a height of about 4-5 inches. It is generally desirable for the extending member 24 (e.g., 24*a*) to be substantial enough in height to be tied to a corresponding extending member 24 (e.g., 24*b*) and to maintain that tied configuration.

As illustrated by FIG. 2, the extending members 24 may be secured to the main body 12 in a way that allows the upper edge 28 of the baby carrier 12 to be an elongated edge that is formed by the upper portion 30 of the main body 12 and the upper portions 32 of extending members 24*a* and 24*b*. The lower edge 34 of the carrier 10 is an elongated edge that is formed by the lower portion 26 of the main body 12 and the lower portions 36 of extending members 24*c* and 24*d*. This elongated lower edge 34 helps ensure that the child being carried cannot fall out of the side of the baby carrier 10.

Figure 5:
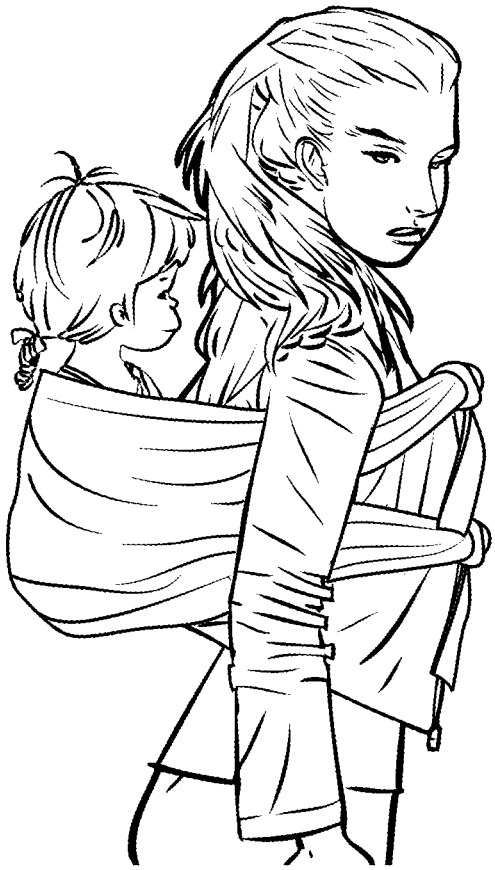
FIG. 5 shows a side perspective view of a child positioned in a baby carrier described herein.

An example of tied extending members 24 is shown by FIG. 4. In this figure, upper extending members 24*a* and 24*b* are tied to one another. They extend under the wearer's armpits and may be tied generally above the breast of the wearer. Lower extending members 24*c* and 24*d* are tied to one another. They extend around the wearer's waist and are tied generally at the position where a belt would be secured, near the wearer's belly button. The extending members 24 wrap snugly around the wearer's entire circumference. This configuration is believed to properly position the child in the backpack baby carrier 10 while distributing weight in an appropriate and desirable manner. FIG. 5 shows an example of a child positioned in the baby carrier as described.

Baby carrying is a skill that should be practiced, just like any other skill, in order to ensure comfortable and safe carrying of the child according to the steps specified below. In use, the baby carrier 10 is placed on the bed or other surface and spread out. The child to be carried may be placed on the main body 12 of the carrier. The child's shoulders should generally be on the same level with the upper edge 28 of the carrier. The caregiver may lean slightly back toward the child, with his/her back against the child's open legs. The caregiver may then pull the main body 12 of the carrier 10 against the child's back, while pulling the child onto the caregiver's back. Each leg of the child may wrap around the sides of the caregiver's waist. This position can balance the child's weight against the caregiver's central body, which prevents the child from putting undue strain on the caregiver's back.

Once the child and the main body 12 are pulled upright, the caregiver ties the first and second upper extending members 24*a* and 24*b* to one another, and ties the first and second lower extending members 24*c* and 24*d* to one another. Examples of this step are shown in FIGS. 4 and 5. The extending members 24 may be pulled and tied, while the baby is also pulled closer to the caregiver. The extending members 24 may be doubled knotted for safety and comfort. The child is then secured in the baby carrier 10. FIGS. 4 and 5 illustrate a child properly positioned in a baby carrier described herein. Depending upon the child's size and leg length, a substantial portion of the child's legs may be secured within the main body 12 and the lower extending members 24*c* and 24*d*, preventing dangling legs.

In this position, the baby carrier 10 also promotes a spread leg position of the child being carried, thereby preventing blood supply constriction for both the child and the caregiver. One of the child's legs is wrapped around one side of the caregiver's waist, and the other of the child's legs is a wrapped around the other side of the caregiver's waist, such that the child straddles the caregiver's back. This is securely holds the child in place, while leaving the child's head unencumbered for movement and breathing. It is generally believed that this is an appropriate position when a baby is 4 months and older. When a baby is younger than 4 months, it is recommended that his/her legs stay together and wrap to one side of the baby carrier only.

The baby carrier 10 is designed to conform to the natural body movement and posture of the adult wearer, so that the load is evenly distributed over the adult body. The baby carrier allows the child to be held in a position that is healthy for the spinal and hip socket development of the child, as well. Another benefit of the baby carrier 10 described herein is that it allows bonding between the caregiver and the child, due to the close connection created while wearing. The child being carried can enjoy the body rhythm of the caregiver, due to being close to the caregiver's body during carrying.

The use of four straps/extending members of 24 renders the baby carrier 10 described herein more comfortable and easier to adjust than a system with many more pairs of straps or clips/brackets/rings. The extending members 24 may be reinforced with multiple stitches to prevent unraveling and to prevent the extending members 24 from separating from the main body 12.

The baby carrier 10 may be made out of a soft, washable material. Examples include but are not limited to cotton, flannel, polyester, nylon, spandex, polyester fiber/cotton blend, viscose, rayon, jersey, or any combinations thereof, or any other appropriate materials. It is generally desirable for the material to be washable so that spills, spit up, or other soils may be easily removed. The thread used to sew the extending members 24 to the main body 12 and for other stitching may be a strong upholstery thread. One example is a polyester thread, which is durable and rot proof. One of the benefits of the baby carrier described herein is that it lacks any buckles, clamps, or rings that would make washing the carrier difficult or potentially damaging to a user's washing machine. The baby carrier 10 may be manufactured so that it is reversible, having a pleasing pattern on both sides. This can allow the baby carrier to also function as a fashion statement.

Figure 6:
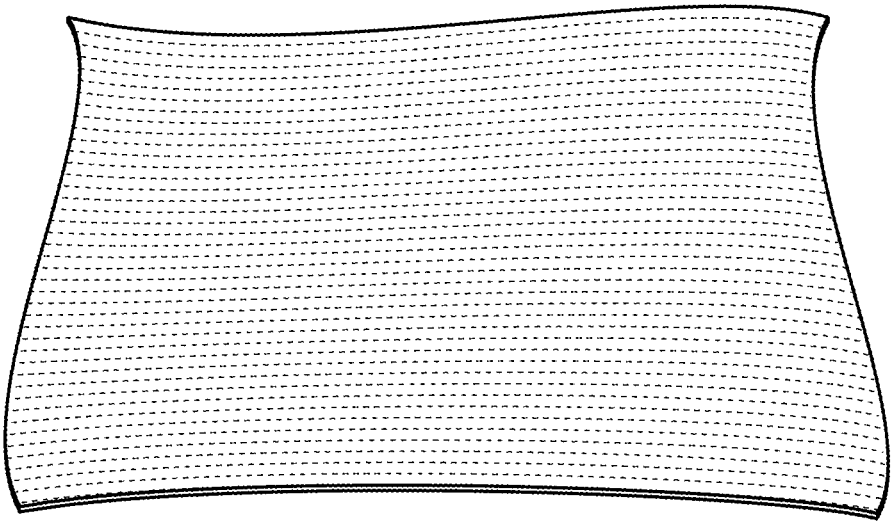
FIG. 6 shows an example of a blanket that may be used to wrap around the baby carrier in use.
Figure 7:
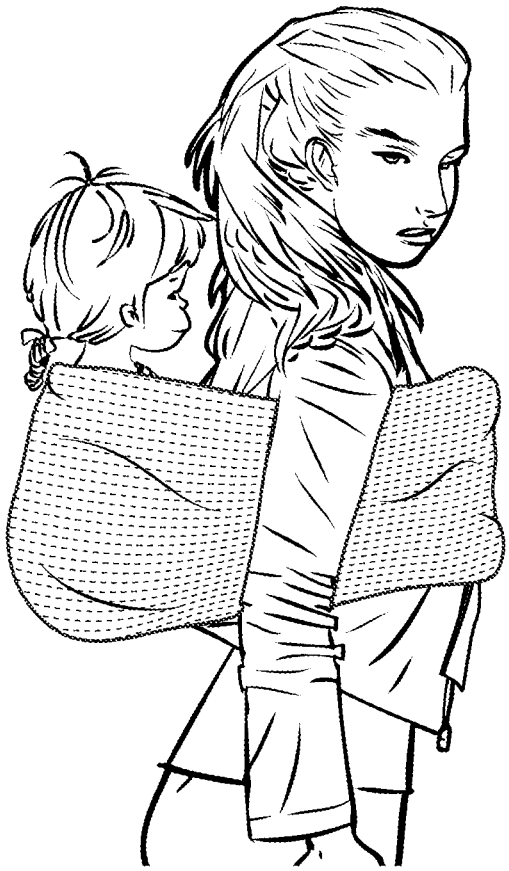
FIG. 7 shows a child properly positioned in a baby carrier, with a blanket tucked and positioned therearound.
Figure 8:
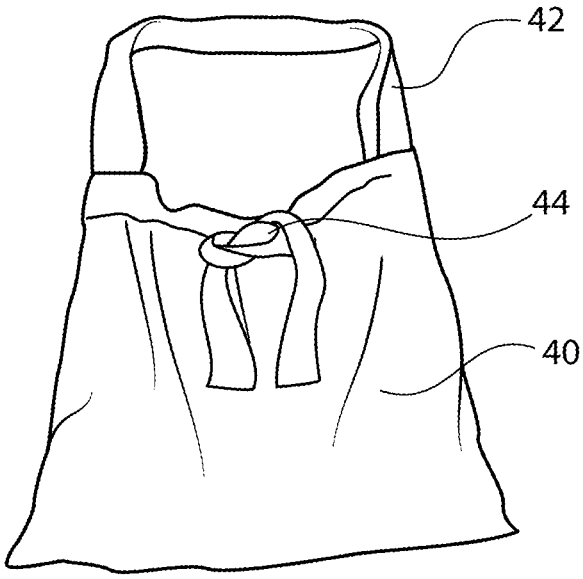
FIG. 8 shows one embodiment of a carrying bag that may be provided with a baby carrying system.

In one system, the baby carrier 10 is provided with a blanket 36 and a carrying bag 40, as illustrated by FIGS. 6 and 8, respectively. The blanket 36 and carrying bag of 40 are desirably made from the same material pattern as the baby carrier, or a complementary material pattern. (A "complementary material pattern" is considered any material pattern that coordinates with or otherwise schematically or color-wise complements or matches the material of the baby carrier 10.) The blanket 36 may comprise an elongated rectangular fabric portion. The blanket 36 may be sized to wrap around the baby carrier 10. Examples of the blanket and it's wrapping around the baby carrier is shown in FIG. 7. The blanket 36 may be tucked into extending members 24 in use, in order to provide extra security and/or protection against sun and insects. In one embodiment, the blanket may be about 6 to about 7 feet long and about 3 to about 4 feet high.

The carrying bag 40 is desirably made from the same material pattern as the baby carrier, or a complementary material pattern. An exemplary carrying bag of 40 is illustrated by FIG. 8. The carrying bag 40 may be designed with a padded strap 42 and a draw string 44. The carrying bag of 40 is generally sized to fit the folded baby carrier 10 and blanket 36 therein.

Changes and modifications, additions and deletions may be made to the structures and methods recited above and shown in the drawings without departing from the scope or spirit of the disclosure or the following claims.

What is claimed is:

1. A baby carrier system, comprising:

(a) a baby carrier comprising:

a first fabric panel defining a main body comprising a rectangular panel sized and configured for supporting a child to be carried, first and second upper extending members sized and configured for wrapping around a caregiver's upper torso and being tied, the first and second upper extending members secured to upper side edges of the main body to create a straight, elongated upper edge that is formed by an upper portion of the main body and upper portions of the first and second upper extending members, and first and second lower extending members sized and configured for wrapping around a caregiver's lower torso and being tied, the first and second lower extending members secured to lower side edges of the main body to create a straight, elongated lower edge that is formed by a lower portion of the main body and lower portions of the first and second lower extending members, wherein side portions of the main body define straight side edges, wherein the baby carrier is formed without buckles, a frame, or rings;

wherein the main body is padded;

(b) a blanket sized to have a length that wraps around the entire baby carrier; and (c) a carrying bag.

2. The baby carrier system of claim 1, wherein the main body has a length of 30 inches and a height of 24 inches.

3. The baby carrier system of claim 1, wherein each of the upper and lower extending members have a length of 30 inches and a height of 4 inches.

4. The baby carrier system of claim 1, wherein the baby carrier, the blanket, and the carrying bag are formed from the same material pattern.

5. A method for carrying a child on a caregiver using the baby carrier system of claim 1, comprising:

laying the baby carrier on a raised surface;

positioning a child such that the child's shoulders are aligned with an upper edge of the baby carrier;

pulling the child and the main body of the baby carrier toward the caregiver;

tying the first and second upper extending members to one another, wherein the first and second upper extending members traverse under the caregiver's armpits;

tying the first and second lower extending members to one another, wherein the first and second lower extending members traverse around the caregiver's waist.

6. The method of claim 5, further comprising positioning the blanket around the baby carrier.

* * * * *